US007618032B2

(12) United States Patent
Deschryver

(10) Patent No.: US 7,618,032 B2
(45) Date of Patent: Nov. 17, 2009

(54) SPINNING WHEEL FORMAT

(75) Inventor: David Deschryver, Geneva, IL (US)

(73) Assignee: Lehigh Press, Inc., Broadview, IL (US)

( * ) Notice: Subject to any disclaimer, the term of this patent is extended or adjusted under 35 U.S.C. 154(b) by 393 days.

(21) Appl. No.: 11/279,024

(22) Filed: Apr. 7, 2006

(65) Prior Publication Data

US 2006/0213635 A1 Sep. 28, 2006

(51) Int. Cl.
*B41F 13/58* (2006.01)

(52) U.S. Cl. ..... 270/5.03; 270/10; 270/21.1; 53/206

(58) Field of Classification Search ..... 270/5.01, 270/5.02, 5.03, 10, 20.1, 21.1, 4; 53/203, 53/206, 450, 461, 548, 550, 553; 283/81, 283/100, 101

See application file for complete search history.

(56) References Cited

U.S. PATENT DOCUMENTS

| | | | | |
|---|---|---|---|---|
| 3,808,768 | A | 5/1974 | Dobbs | |
| 4,063,398 | A | 12/1977 | Huffman | |
| 4,071,997 | A | 2/1978 | Gunther, Jr. et al. | |
| 4,189,895 | A | 2/1980 | Volkert et al. | |
| 4,215,626 | A | 8/1980 | Giulianotto | |
| 4,455,809 | A | 6/1984 | Dallaserra | |
| 4,769,969 | A | 9/1988 | Minami | |
| 4,790,119 | A | 12/1988 | McDaniels | |
| 5,057,067 | A | 10/1991 | Hibsch | |
| 5,137,304 | A | 8/1992 | Silverschotz et al. | |
| 5,160,022 | A | 11/1992 | Mennella | |
| 5,417,458 | A | 5/1995 | Best et al. | |
| 5,776,287 | A | 7/1998 | Best et al. | |
| 6,070,391 | A | 6/2000 | Honegger | |
| 6,315,023 | B1 | 11/2001 | King et al. | |
| 6,658,817 | B1 | 12/2003 | Eve et al. | |
| 6,712,398 | B1 | 3/2004 | Fox et al. | |
| 7,241,357 | B2 * | 7/2007 | Roth et al. | 156/250 |
| 2003/0028439 | A1 | 2/2003 | Cox et al. | |
| 2005/0006445 | A1 | 1/2005 | Katz | |

FOREIGN PATENT DOCUMENTS

| | | | |
|---|---|---|---|
| WO | WO 92/00878 | A1 | 1/1992 |
| WO | WO 03/095114 | A1 | 11/2003 |

* cited by examiner

*Primary Examiner*—Ren Yan
(74) *Attorney, Agent, or Firm*—Trexler, Bushnell, Giangiorgi, Blackstone & Marr, Ltd.

(57) ABSTRACT

A spinning wheel format having a wheel rotatable about an axle, both carried within a substrate, wherein the substrate, the wheel, and the axle are made from the same stock, created in a continuous, single-pass finishing system, is described. The format is manufactured by adhering a first ribbon to a second ribbon to form a multi-ply ribbon, cutting the multi-ply ribbon to form a plurality of wheels and axles within the wheels, marrying the multi-ply ribbon to a third ribbon, folding the third ribbon to enclose the multi-ply ribbon within the folded third ribbon; and transversely cutting the third ribbon into a plurality of spinning wheel formats. A mass distributable packet can be created by marrying a plurality of spinning wheel formats to a fourth ribbon, and manufacturing a plurality of mass distributable packets from the fourth ribbon.

13 Claims, 9 Drawing Sheets

SPINNING WHEEL FORMAT

FIELD OF THE INVENTION

This invention is generally directed to an in-line finishing system for manufacturing a spinning wheel format. A spinning wheel format, as used herein, is a format in which a rotatable wheel is carried by a substrate and can be manipulated to expose a selected printed portion thereon through one or more openings in a face portion and/or base portion of the substrate or on a portion of the wheel extending from the substrate. The wheel is generally carried between the face portion and the base portion of the format.

BACKGROUND OF THE INVENTION

Advertisers commonly use mass-distributable packets to promote their products. These packets are distributed by mail, by insert into newspapers or other periodicals, by hand delivery, or otherwise. Advertisers use various specialty products, including but not limited to spinning wheel formats, to enhance the appeal of the mass-distributable packets.

Mass-distributable packets are conventionally printed on a web press and finished on an in-line finishing system associated with the web press, in a single press run, from a single web. The packets are prepared by printing the information to appear on the packets in a plurality of longitudinal areas extending parallel to the web, cutting the web longitudinally between the print patterns to form ribbons, superimposing the cut ribbons in a vertical registry, and then cutting the ribbons transversely to form the sets of printed pieces. The ribbons can be folded and cut in a variety of ways to create many different forms.

It is particularly desirable to minimize the cost of manufacture and to maximize the speed of production. In the prior art, spinning wheel formats were made by attaching the wheel to the face portion and/or to the base portion by a metal grommet. This method is time-consuming as well as expensive, requiring the use of separate materials and complicated assembly techniques. Additionally, the spinning wheel format then had to be added to the mass-distributable packet by a tip-on process, which caused at least alignment problems and increased make-ready time. It would be advantageous to be able to manufacture a spinning wheel format in a continuous single-pass finishing system, and especially to do so for production of mass-distributable packets of printed materials.

One improvement on the metal grommet assembly was described in U.S. Pat. No. 5,057,067 to Hibsh, Method of Making a Paper Spinning Wheel Product, which used a single-pass finishing system, and the disclosure of which is incorporated herein. In this grommetless method, the spinning wheel format is manufactured in a single pass from a continuous web. Problems arise from this method, however. Because of the way the wheel is cut from a ribbon of the web, the wheel of the format is octagonal in shape, rather than circular, which detracts from the spinning-wheel appearance. Additionally, the wheel rotates about a glue area, which serves as an axle. There is poor alignment between the wheel and the axle, so the wheel turns somewhat haphazardly rather than smoothly.

Accordingly, there is a need for a smoothly spinnable spinning wheel format, for a less-expensive, easily set up, single-pass system for creating a spinning wheel format, and a need for a system for incorporating the spinning wheel format into a mass-distributable packet. The present invention meets these needs.

SUMMARY OF THE INVENTION

Briefly, and in accordance with the foregoing, the present invention, in a first embodiment, is a spinning wheel format having a wheel rotatable about an axle, both carried within a substrate, wherein the substrate, the wheel, and the axle are made from the same stock, created in a continuous, single-pass finishing system, by applying glue to at least one of a first ribbon and a second ribbon, marrying the first ribbon and the second ribbon to form a multi-ply ribbon, cutting the multi-ply ribbon to form a plurality of wheels and axles within the wheels, marrying the multi-ply ribbon to a third ribbon, folding the third ribbon to enclose the multi-ply ribbon within the folded third ribbon; and transversely cutting the third ribbon into a plurality of spinning wheel formats.

In another embodiment, the present invention is a mass distributable packet, created in a continuous, single-pass finishing system, by marrying a plurality of spinning wheel formats as described above to a fourth ribbon, and manufacturing a plurality of mass distributable packets from the fourth ribbon.

In yet another embodiment, the present invention is a method of manufacturing a spinning wheel format in a continuous, single-path finishing system, by applying glue to at least one of a first ribbon and a second ribbon, marrying the first ribbon and the second ribbon to form a multi-ply ribbon, cutting the multi-ply ribbon to form a plurality of wheels and axles within the wheels, marrying the multi-ply ribbon to a third ribbon, folding the third ribbon to enclose the multi-ply ribbon within the folded third ribbon; and transversely cutting the third ribbon into a plurality of spinning wheel formats.

In yet another embodiment, the present invention is a method of manufacturing mass distributable packets, created in a continuous, single-pass finishing system, by marrying a plurality of spinning wheel formats as described above to a fourth ribbon, and manufacturing a plurality of mass distributable packets from the fourth ribbon.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1A:
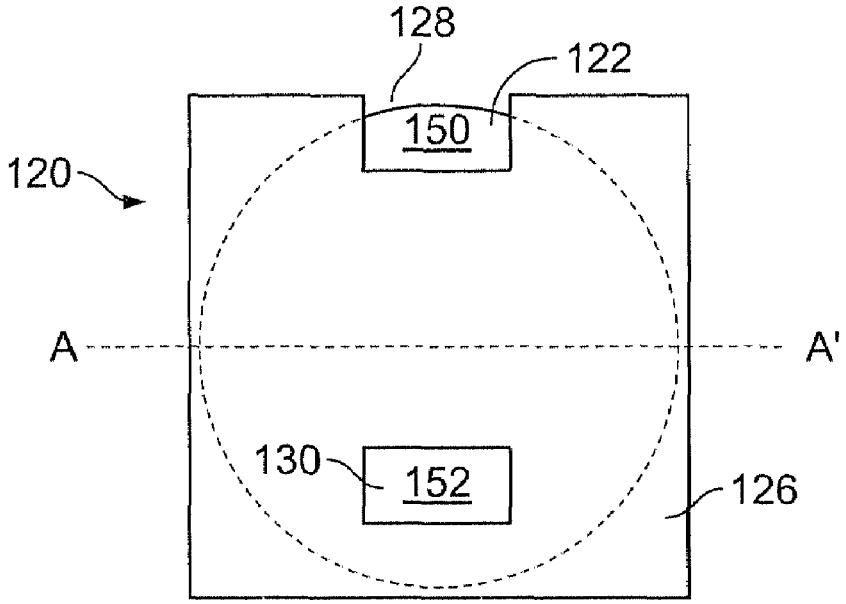
FIG. 1A is a plan view of a format of one embodiment of the spinning wheel format of the present invention.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 1B:
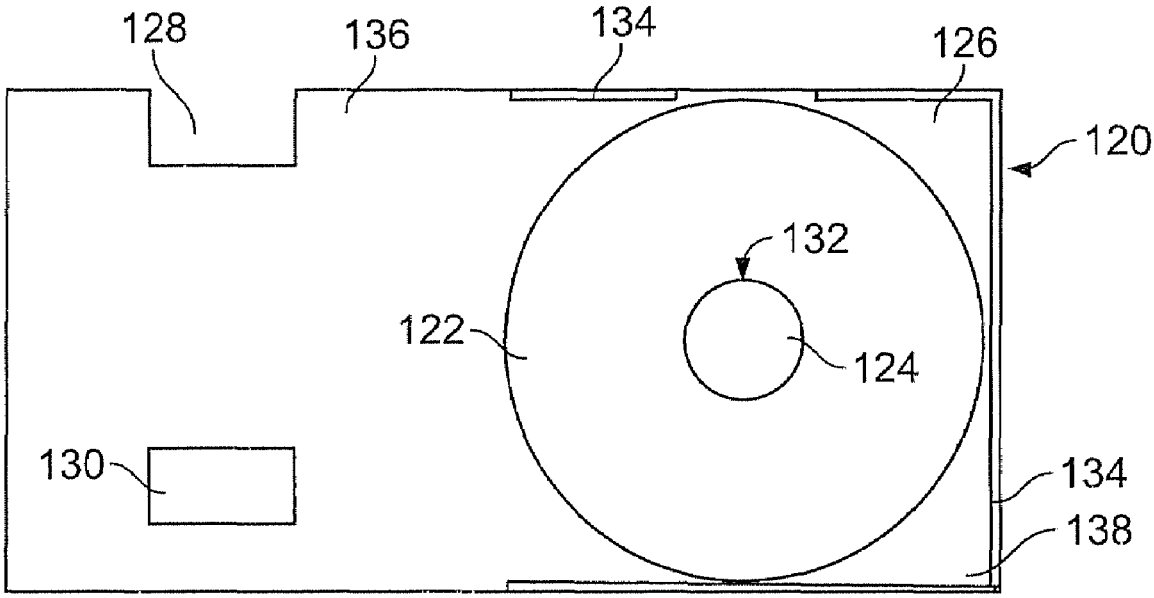
FIG. 1B is a plan view of a partially disassembled format of FIG. 1A.
Figure 1C:
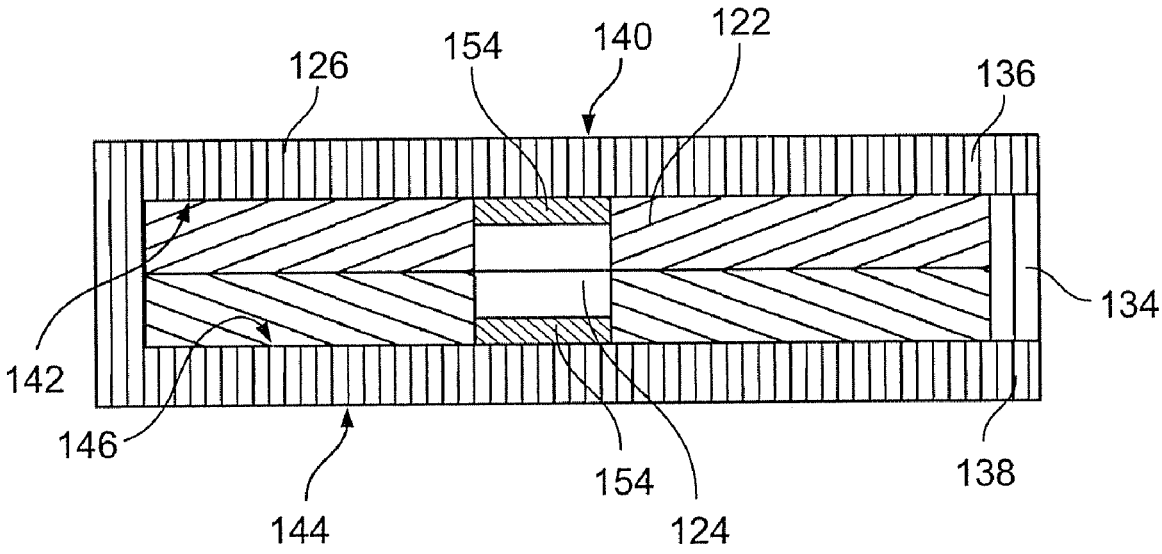
FIG. 1C is a cross-sectional view of the format of FIG. 1A.

FIGS. 1A, 1B, and 1C show a first embodiment of a sample spinning wheel format 120 as manufactured by the preferred embodiment of the present invention. The format 120 has a wheel 122, an axle 124, and a four-pager substrate 126 having an edge window 128 and an interior window 130. Wheel 122 is separated from axle 124 by die cut 132. Glue portion 134 holds substrate 126 in the folded position shown in FIGS. 1A and 1C. Four-pager substrate 126 has a face portion 136 and a base portion 138. Face portion 136 has a first side 140 and a second side 142 and base portion 138 has a first side 144 and a second side 146, thereby forming the four pages of substrate 126.

FIG. 1A shows the format 120 in assembled condition, with the portion of wheel 122 that is unable to be seen shown in outline. Exposed portions 150, 152 of wheel 122 are visible through windows 128, 130. FIG. 1B shows the sample spinning wheel format 120 in unassembled condition, with the substrate 126 unfolded to expose the entire wheel 122. FIG. 1C is a cross-sectional view of sample spinning wheel format 120 as seen through line A-A' of FIG. 1A, with face portion 136 folded over and sealed to base portion 138. Glue 134 seals second side 142 of face portion 136 to second side 146 of base portion 138. Wet glue 154 seals axle 124 to second side 142 of face portion 136 and to second side 146 of base portion 138, so that wheel 122 is retained inside substrate 126. Since wheel 122 is separated from axle 124 by die cut 132, wheel 122 can rotate in the plane of format 120 but cannot be pulled out of format 120. Application of force to wheel 122, for example by a user's thumb at window 128, will rotate wheel 122. Different information printed in different parts of wheel 122 will appear to the user through windows 128 or 130 as wheel 122 is rotated.

Figure 2A:
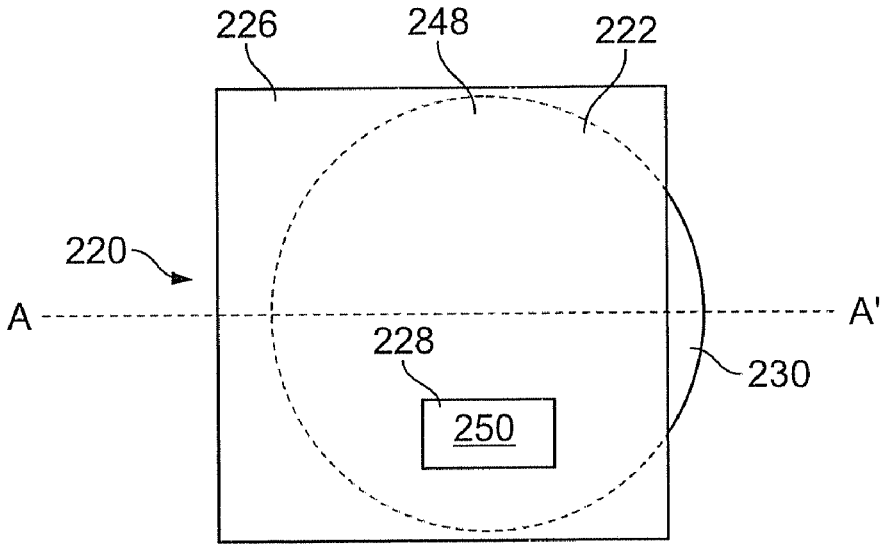
FIG. 2A is a plan view of a format of another embodiment of the spinning wheel format of the present invention.
Figure 2B:
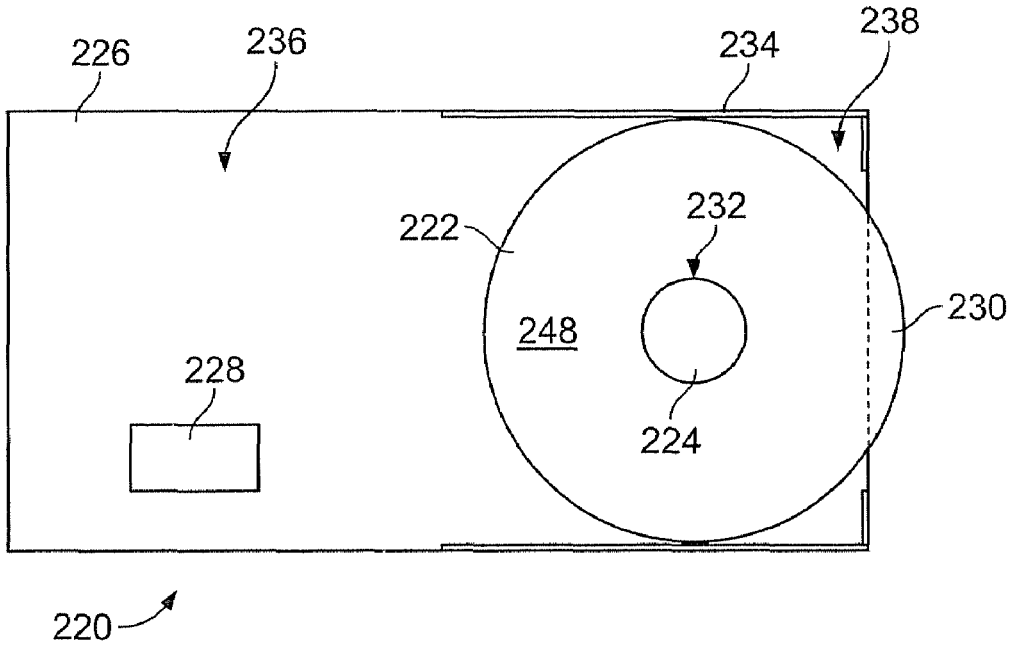
FIG. 2B is a plan view of a partially disassembled format of FIG. 2A.
Figure 2C:
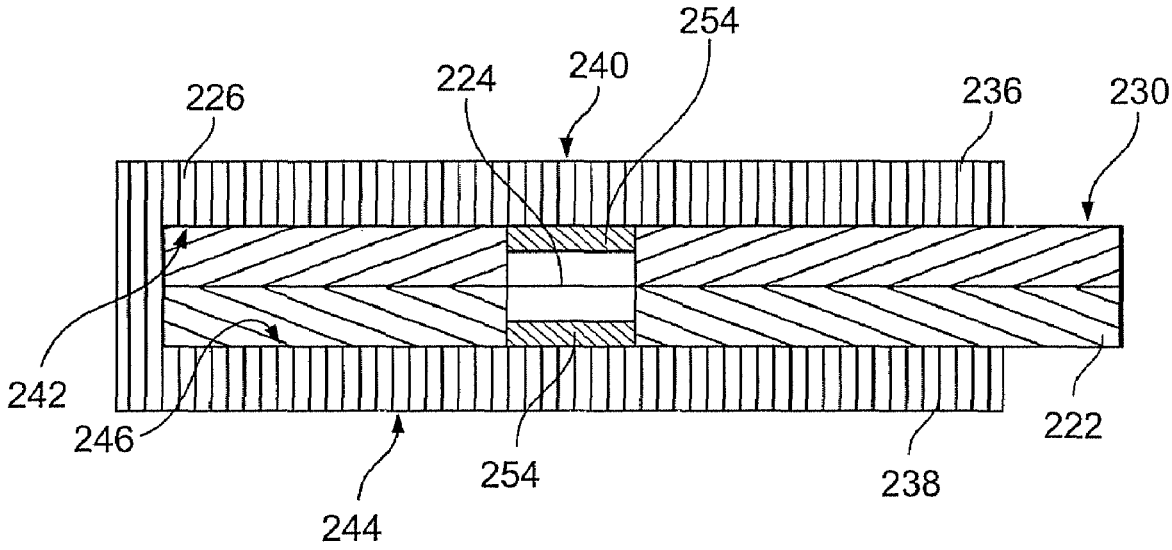
FIG. 2C is a cross-sectional view of the format of FIG. 2A.

FIGS. 2A, 2B, and 2C show another embodiment of a sample spinning wheel format 220 as manufactured by the preferred embodiment of the present invention. The format 220 has a wheel 222, an axle 224, and a four-pager substrate 226 having an interior window 228. Portion 230 of wheel 222 extends outside of substrate 226. Wheel 222 is separated from axle 224 by die cut 232. Glue portion 234 holds substrate 226 in the folded position shown in FIGS. 2A and 2C. Four-pager substrate 226 has a face portion 236 and a base portion 238. Face portion has a first side 240 and a second side 242 and base portion 238 has a first side 244 and a second side 246, thereby forming the four pages of substrate 226.

FIG. 2A shows the format 120 in assembled condition, with the inside portion 248 of wheel 122 that is unable to be seen shown in outline. Exposed portion 250 of wheel 222 is visible through window 228. FIG. 2B shows the sample spinning wheel format 220 in unassembled condition, with the substrate 226 unfolded to expose the entire wheel 222. FIG. 2C is a cross-sectional view of sample spinning wheel format 220 as seen through line A-A' of FIG. 2A, with face portion 236 folded over and sealed to base portion 238. Glue 234 seals second side 242 of face portion 236 to second side 246 of base portion 238. Wet glue 254 seals axle 224 to second side 242 of face portion 236 and to second side 246 of base portion 238, so that wheel 222 is retained inside substrate 226. Since wheel 222 is separated from axle 224 by die cut 232, wheel 222 can rotate in the plane of format 220 but cannot be pulled out of format 220. Application of force to wheel 222, for example by a user's thumb at portion 230, will rotate wheel 222. Different information printed in different parts of wheel 222 will appear to the user through window 228 or at exposed portion 230 as wheel 222 rotates.

The spinning wheel formats 120, 220 can be made in combination and can be made with any number or combination of windows such as edge window 128 or interior windows 130, 228.

As can be seen from FIGS. 1C and 2C, the wheel of the present invention is preferably a multi-ply stock. Having a wheel heavier than the substrate confers advantages to the spinning wheel format. The heavier the stock of the axle, the more easily the wheel will turn about the axle and the stronger will be the entire construction. However, it would be more expensive to manufacture the axle, or the wheel and the axle, from heavier stock paper than the substrate, because the two elements then could not be printed in a single-pass process. Accordingly, a multi-ply format is used for the wheel in the preferred embodiment. However, a single-ply wheel of the same stock as the substrate could also be used. Moreover, the substrate itself could be manufactured in a multi-ply stock, either with the same number of plies as the wheel or with a different number of plies.

Please note that FIGS. 1C and 2C illustrate a simple two-layer or two-ply wheel. Thus, in the illustrated example, if substrate 126 or 226 is printed on seven-point paper (0.007 inch thick), the wheel 122 or 222 will appear to the recipient to have been printed on 14-point paper (0.014 inch thick), even though both the substrate 126 or 226 and the wheel 122 or 222 were printed on the same seven-point paper. Moreover, a wheel and axle with three or more layers can also be made using the present invention.

The system of manufacturing spinning wheel format 220 will now be described, but the system is equally applicable to printing spinning wheel format 120. The system will be described for manufacturing a spinning wheel format 220 as part of a mass-distributable packet. The system can be used, however, to create stand-alone spinning wheel formats 220 for distribution without other material.

Figure 3:
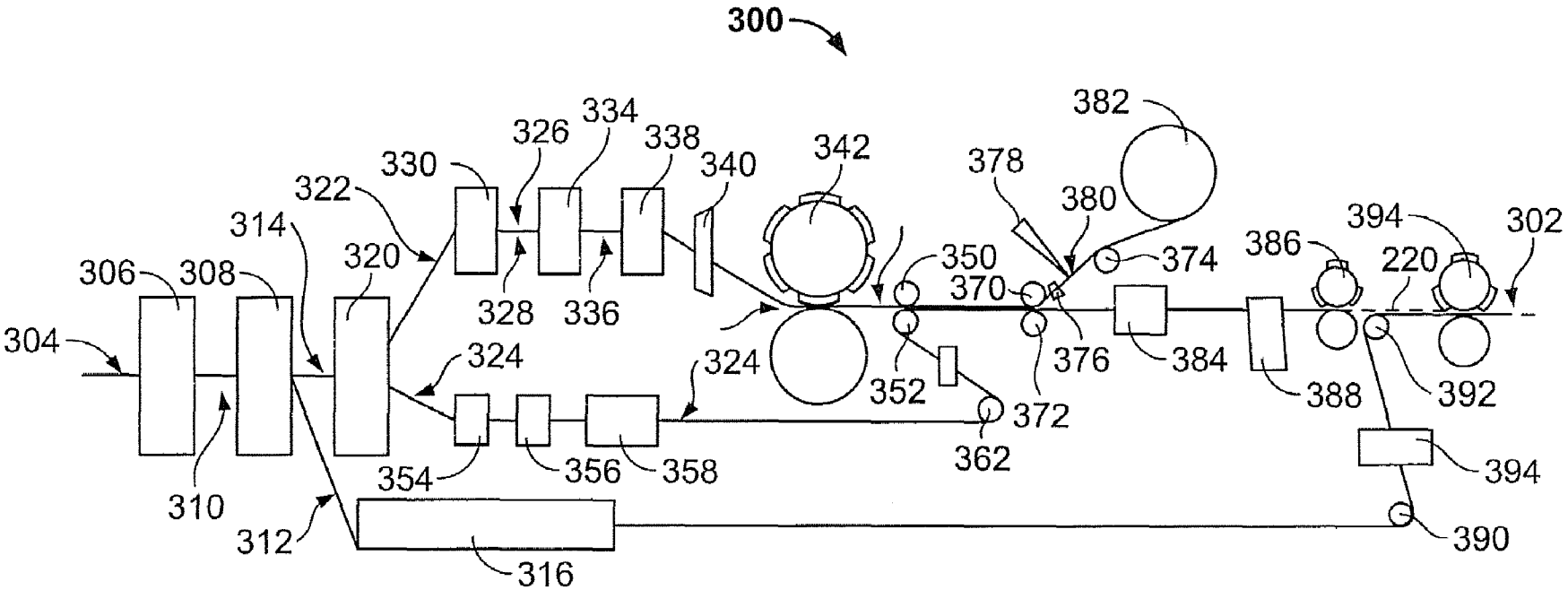
FIG. 3 is an elevation diagram of the devices used to manufacture the spinning wheel format in one embodiment of the method of the present invention.

FIG. 3 shows the system 300 for manufacturing format 220. The information to be provided on mass distributable packet 302, which can include by way of example and not by way of limitation such information as advertising, a contest, or trivia, is printed on a web of paper 304 in a standard web press 306. A first slitter 308 cuts the printed web 310 into a first ribbon 312 and a second ribbon 314. First ribbon 312 can be finished, which includes by way of examples and not by limitation, being slit, cut, folded, glued, aqueous coated, overall and spot UV coated, film laminated, embossed, foil and hologram stamped, and/or post embossed, in any number of finishing operations at finishing station 316 as is well known in the art to form a mass distributable packet 302, to which the spinning wheel format 220 will be inserted, as will hereinafter be described. Second ribbon 314 is manufactured into spinning wheel format 220.

Second slitter 320 cuts second ribbon 314 into an upper ribbon 322 comprising what will become the wheel 222 in the spinning wheel format 220, and a lower ribbon 324 comprising what will become the substrate 226 of the format 220.

Please note that second ribbon 314 can first be slit into numerous pairs of ribbons, each pair of which becomes an upper ribbon 322 and a lower ribbon 324 as described herein. Accordingly, the following description is of a simple two-ribbon embodiment, but the principles of the invention are adaptable to multiple-ribbon applications.

In the example method shown, upper ribbon 322 has a printed side 326 and a non-printed side 328. Upper ribbon 322 is rolled over an applicator 330 that applies glue to the non-printed side 328 of upper ribbon 322. "Glue" as used herein means any material, natural or synthetic, having adhesive properties. Upper ribbon 322 is then folded upon itself and thereby glued to itself by first plow 334 to become a multi-ply ribbon 336. In the illustrated embodiment, upper ribbon 322 is folded upon and glued to itself once, so that multi-ply ribbon 336 now has twice the thickness of the original paper of web 304. Additionally, multi-ply ribbon 336, having been formed by folding upper ribbon 322 in half, with printed side 326 to the outside, now has printed information on both sides. (If the user wants printed information on only one side of wheel 220, only half of printed side 326 is printed.) Thus, in the illustrated embodiment, multi-ply ribbon 336, which will be cut into wheel 220, appears to be twice the thickness of the lower ribbon 324 and has information on both sides. More plows can be added in any combination to fold upper ribbon 322 to create triple ply, quadruple ply, or higher order thicknesses. Because the upper ribbon 322 is folded to create multiple layers, the finished wheels 220, as will hereinafter be described, appear to be of heavier stock than the substrate 226 or of the packets 302 to which the spinning wheel format 220 will be are attached, even though the wheel 220, the substrate 226, and packets 302 were all originally printed from the same web 304.

Please note that in the illustrated embodiment, slitter 320 is located before applicator 330 and first plow 334. In another embodiment, slitter 320 is located after applicator 330 and first plow 334. In this embodiment, applicator 330 applies glue to second ribbon 314 and first plow 334 folds one-third of second ribbon 314 upon itself, along a first fold line, to form a multi-ply portion of ribbon 336. Second ribbon 314 in this embodiment has a double layer of paper, or two plies, on half of its width, and a single layer of paper, or one ply, on the other half. Slitter 320 then cuts second ribbon 314 down the middle to form multi-ply ribbon 336 and lower ribbon 324.

In another embodiment, slitter 320 is located before applicator 330 and first plow 334. In this embodiment, however, applicator 330 applies glue to second ribbon 314 and first plow 334 folds second ribbon 314 upon itself to form multi-ply ribbon 336. Multi-ply ribbon 336 in this embodiment has a double layer of paper, or two plies, on its entire width. Slitter 320 then cuts multi-ply ribbon 336 to sever lower ribbon 324, which, in this embodiment, also has two plies, like multi-ply ribbon 336.

Accordingly, when a plow folds a ribbon upon itself, as used in the present invention, the ribbon may be completely folded over itself or partially folded over itself.

In another embodiment, other finishing operations are applied to upper ribbon 322 or to multi-ply ribbon 336. For example, a coating, such as a varnish, may be applied to upper ribbon 322 at coating station 338. Varnish will provide a slick appearance and feel to wheel 220, allowing it to spin more freely within the spinning wheel format 220. Other coatings can be used to create a slick appearance and feel, including UV coating and other coatings that are known in the printing art.

In one embodiment, coating such as varnish is applied only to those portions of upper ribbon 322 that will become wheel 222, and not to those portions of upper ribbon 322 that will become axle 224. In another embodiment, coating is applied to all portions of upper ribbon 322.

Please note that coating station 338, shown in the preferred embodiment located after plow 334, can alternatively be placed before first slitter 308, after first slitter 308, or elsewhere. Accordingly, coating can be applied to upper ribbon 322 before it is folded, or to multi-ply ribbon 336 after the folding operation. Other coatings can be used as is known in the art, and other finishing operations can be used as is known in the art.

Furthermore, the web 310, the packets 302, or either of the ribbons 322, 324 can be printed with personalized information, by printing the personalized information with the web press 312 or by using a separate, but in-line, inkjet printer 340. Personalized information can be personalized as to the recipient. For example, a spinning wheel format being an advertisement for a national health club might include the name and address of the recipient. Personalized information can be personalized as to the sender. For example, the same spinning wheel format might include the address of the nearest health club to the recipient.

Preferably, upper ribbon 322 is printed with personalized information after it has been folded into multi-ply ribbon 336, but printer 340 can be placed to apply this information at a different point in the system.

Figure 4:
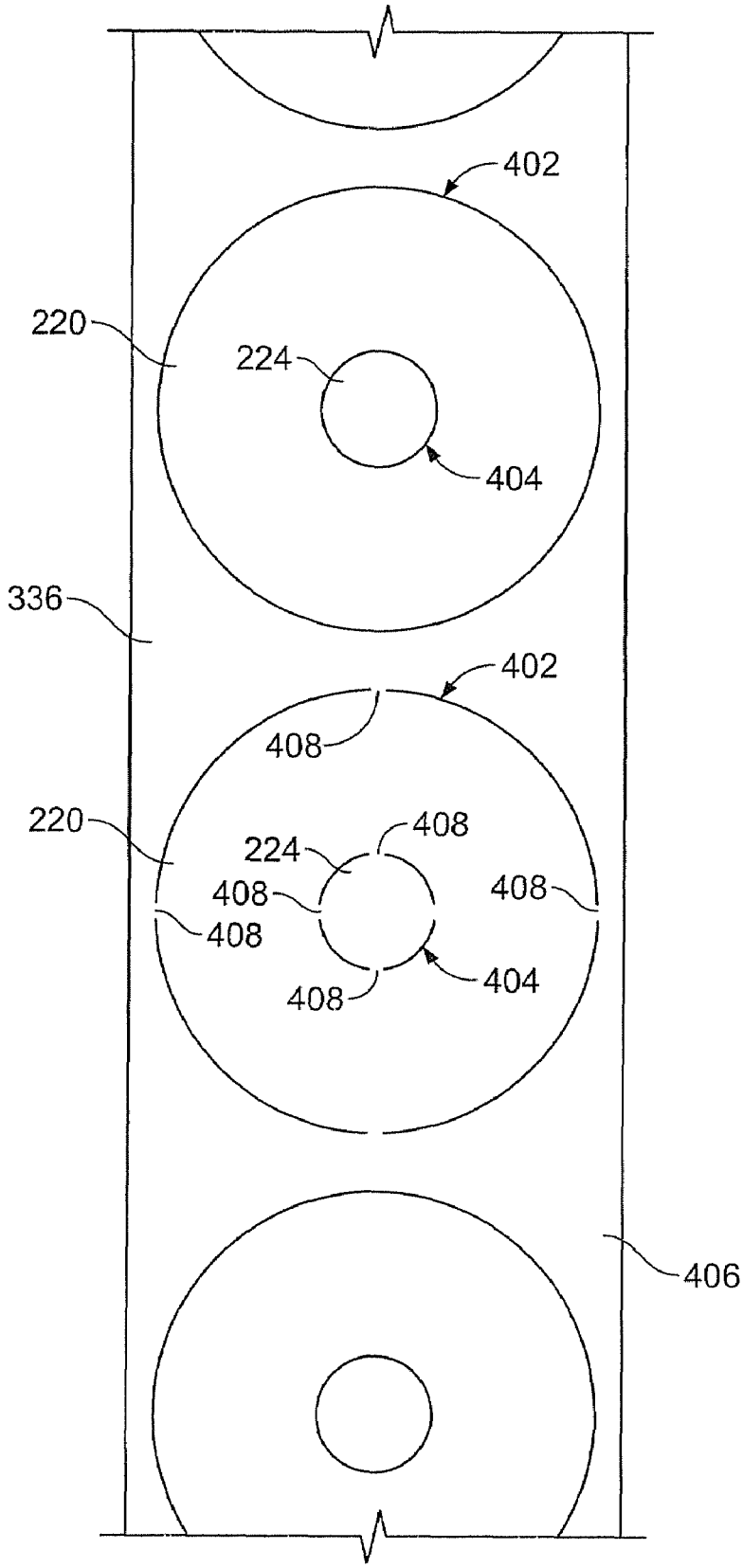
FIG. 4 is a plan view of a ribbon of one embodiment of the present invention.

In the preferred embodiment, multi-ply ribbon 336 next enters a first rotary die cutter 342, which makes die cuts 402 and 404 in upper ribbon 322, as shown in FIG. 4, so that upper ribbon 322 has an outside portion or matrix 406 separated from wheels 220 by die cuts 402. Wheels 220 are themselves separated from axles 224 by die cuts 404 (232) as previously described.

In the preferred embodiment, first rotary die cutter 342 cuts completely around the periphery of wheel 220 and axle 224, as shown in the upper wheel of FIG. 4. In another embodiment, tabs 408 are left in die cuts 402 and 404, as shown in the middle wheel 220 of FIG. 4. Tabs 408 will tear out as matrix 406 is pulled off, as will be described below.

Multi-ply ribbon 336, upon exiting first rotary die cutter 342, enters a set of marrying rollers 350 and 352, which marry multi-ribbon 336 to lower ribbon 324.

Lower ribbon 324, while the above-described operations were being performed on upper ribbon 322, has proceeded to processing station 354, which performs various finishing operations, which can include but are not limited to aqueous coating, overall and spot UV coatings, film lamination, embossing, foil and hologram stamping, and post embossing. In the preferred embodiment, processing station 354 includes at least a second rotary die cutter 356, which cuts window 228 in lower ribbon 324, and a wet gluer 358, which puts dabs of wet glue 360 at those locations on lower ribbon 324 where axle 224 will be, as will hereinafter be described. (Alternatively, wet gluer 358 could be configured to apply wet glue 360 on multi-ply ribbon 336 at axle 224.) Lower ribbon 324 then is brought over a reversing roller 362 and into the set of marrying rollers 350, 352.

Figure 5A:
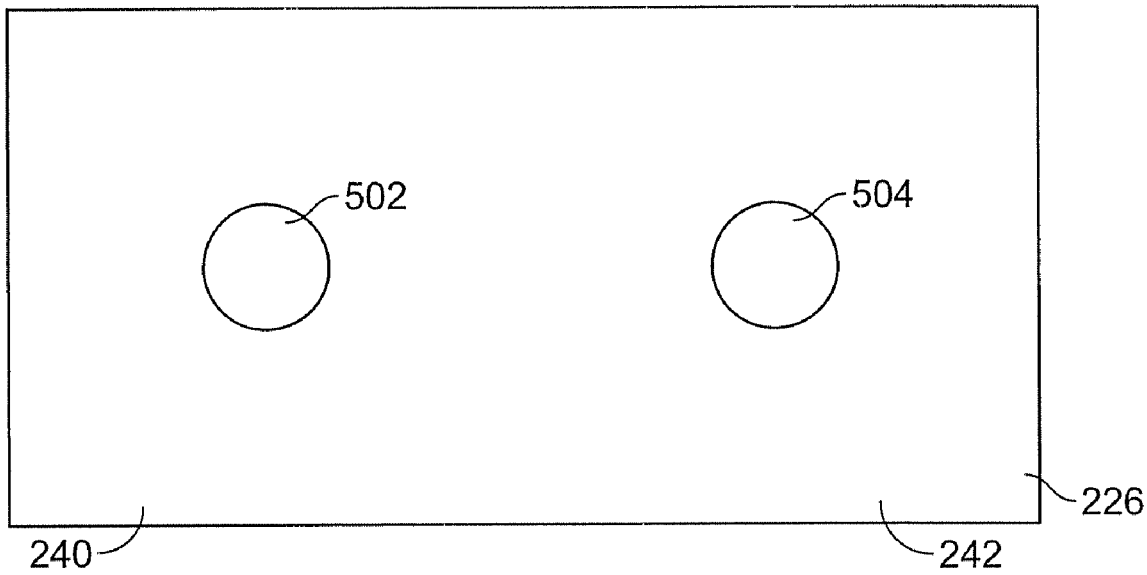
FIG. 5A is a plan view of an unfolded substrate of one embodiment of the invention.

In a first embodiment, as shown in FIG. 5A, wet glue 254 is applied solely within the peripheries of the two portions 502, 504 of substrate 226 that will be in contact with axle 224. When substrate 226 is folded over, as will subsequently be described, the wet glue 254 binds first side 224A of axle 224 to second side 242 of face portion 236, and binds the second side 224B of axle 224 to second side 246 of base potion 238. (If wet gluer 358 applies wet glue 254 to multi-ply ribbon 336, the wet glue 254 is applied only within die cut 404, to axle 224.)

Figure 5B:
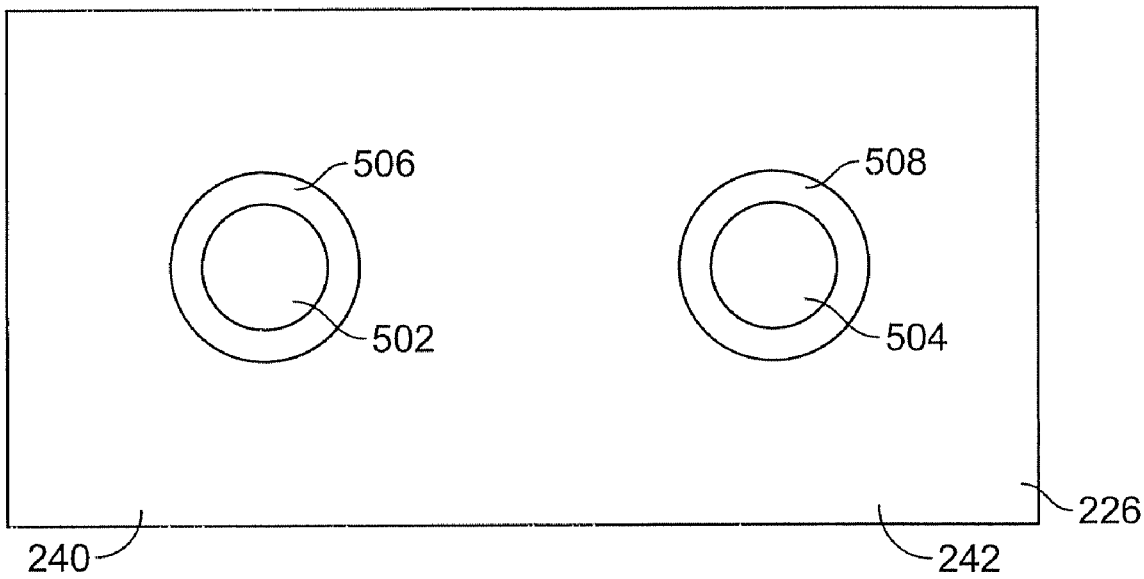
FIG. 5B is a plan view of an unfolded substrate of another embodiment of the invention

In a second embodiment, as illustrated in FIG. 5B, wet glue 254 is applied completely across and slightly beyond the peripheries of portions 502, 504, to cover portions 506, 508. (If wet gluer 358 applies wet glue 254 to multi-ply ribbon 336, the wet glue 254 is applied to corresponding areas.)

In the preferred embodiment, wet gluer 358 also applies wet glue 234 to those areas of lower ribbon 324 that will become the peripheral edges of substrate 226, as shown in FIG. 2B, in order to hold the outer edges of substrate 226 closed when substrate 226 is in the closed position, as shown in FIG. 2A. Please note, however, that the application of glue 254 to portions 502, 504 will hold substrate 226 closed even if the edges are not glued.

The marrying rollers 350, 352 then marry multi-ply ribbon 336 to lower ribbon 324. Please note that multi-ply ribbon 336, being of half the width of lower ribbon 324, is oriented to one side of lower ribbon 324, as lower ribbon 324 will be folded over, as will hereinafter be described. Multi-ply ribbon 336 adheres to lower ribbon 324 by means of the wet glue 254 that was applied previously. The two ribbons 336, 324 then proceed together to a set of nip rollers 370, 372.

After the now married multi-ply ribbon 326 and lower ribbon 324 pass through the nip rollers 370, 372, a pulling roller 374 pulls matrix 406 off lower ribbon 324. In one embodiment, a static bar 376 is used to hold wheel 220 and axle 224 to lower ribbon 324. In another embodiment, an air jet 378 selectively shoots compressed air 380 at multi-ply ribbon 336 but only at wheel 220 and axle 224, not at matrix 406. Static and compressed air can be used together if the user prefers.

In the embodiment illustrated in FIG. 5A, axle 224 is securely glued to substrate 226 and wheel 222 remains with lower ribbon 324, as matrix 406 separates, because of the friction at die cut 232 and the static from static bar 376 or the pressurized air 380. In the embodiment illustrated in FIG. 5B, axle 224 is securely glued to substrate 226 and wheel 222 is partially glued to substrate 226, at portions 506, 508.

Accordingly, matrix 406 is pulled off lower ribbon 324. Wheel 220 stays married to lower ribbon 324, rather than following matrix 406, and matrix 406 is fed to a disposal system 382, preferably a vacuum disposal system.

Lower ribbon 324, now carrying wheel 220 and axle 224, proceeds to finishing stations 384 for further finishing by methods known in the art, which can include but are not limited to further folding, aqueous coating, overall and spot UV coatings, film lamination, embossing, foil and hologram stamping, and post embossing, if desired. As illustrated, finishing stations 384 are located after multi-ply ribbon 336 has been married to lower ribbon 324. In other embodiments, finishing stations 384 can be located elsewhere and finishing operations as described above can be performed elsewhere. For example, finishing operations can be performed on the web 310 before it is printed or after it is printed but before it is slit. Finishing operations can be performed on upper ribbon 322 at any point after the creation of upper ribbon 322 at slitter 320, or on multi-ply ribbon 336 at any point after first plow 334. Finishing operations can be performed on the packets 302 after finishing rotary cutter 386 cuts them, as will be described.

If the edges of substrate 226 have not yet had glue applied, as described above, finishing stations 384 provide a strip of glue 234 at the periphery of half of substrate 226, on second side 246 of base portion 238. Lower ribbon 324, carrying wheels 220 and axles 224, then proceeds through a plow 388 which folds face portion 236 over onto base portion 238, sealing wheel 220 inside format 220.

Lower ribbon 324, now folded in half, proceeds to rotary die cutter 386, which transversely cuts lower ribbon 324 into spinning wheel formats 220. As each individual spinning wheel format 220 proceeds out of rotary die cutter 386, it is married to ribbon 312. Ribbon 312 is brought over rollers 390, 392 and has had dabs of spot glue applied by spot gluer 394. The dabs of spot glue hold spinning wheel formats 220 in place on ribbon 312.

Because the formats 220 are created from a ribbon running parallel to ribbon 312, in a single-pass system, the alignment problems inherent in the "tip-on" process are greatly reduced.

Ribbon 312, now carrying the spinning wheel formats 220, proceeds to finishing die cutter 394 for cutting into individual packets 302 in a manner well known in the art.

Other embodiments of this system can also be used. In an alternative embodiment, upper ribbon 322 is printed on a first web 304A on web press 306 and lower ribbon 324 is simultaneously printed on second web 304B on the same web press 306. The two ribbons 322, 324 are thereafter processed as described above.

In another alternative embodiment, upper ribbon 322 is printed on a first web press 306A and processed as described above. In this embodiment, however, lower ribbon 324 is simultaneously printed on a second web press 306B and processed as described above. The two ribbons 322, 324 are thereafter processed as described above.

In yet another embodiment, a kiss cut is used to create the wheels 222 and axles 224. (Kiss cutting is cutting through a first ribbon and not cutting through a second ribbon that has been married to the first ribbon.) In this embodiment, after upper ribbon 322 has been folded and glued into a multi-ply ribbon 336, as described above, multi-ply ribbon 336 is married to lower ribbon 324 by marrying rollers 350, 352. First die cutter 342 performs kiss-cuts to create the wheels 220 and axles 224 in multi-ply ribbon 336, by cutting multi-ply ribbon 336 into an outside portion or matrix 406 separated from wheels 222 by kiss cuts 402B, and separating axles 224 from wheels 220 by kiss cuts 404B. Because a kiss cut is made, the cuts 402B, 404B do not extend into lower ribbon 324. Pulling roller 374 pulls matrix 406 off lower ribbon 324 as described above and lower ribbon 324, now carrying the wheels 220, proceeds for further finishing as described above.

In yet another embodiment, separate ribbons are glued together to create a multi-ply ribbon. In this embodiment, slitter 310 creates two upper ribbons 322A and 322B. Glue is applied to at least one of upper ribbons 322A and 322B by applicator 330 and upper ribbons 322A and 322B are married, or adhered to each other, to create a multi-ply ribbon 336 (in this case, a two-ply ribbon). That multi-ply ribbon 336 is processed as described above. Upper ribbons 322A and 322B can be slit from a single web printed on a single web press, can be printed separately on a single web press, or can be printed separately on separate web presses.

In yet another embodiment, a combination of folding and separate ribbons is used. To create, for example, a three-ply ribbon, slitter 320 creates two upper ribbons 322C and 220, where upper ribbon 322C is approximately twice the width of upper ribbon 322D. Upper ribbon 322C is then glued at applicator 330 and folded at plow 334. Upper ribbon 322D is sandwiched into upper ribbon 322C during the folding operation, to create a three-ply ribbon. That three-ply ribbon 336 proceeds to be married to lower ribbon 324 as described above. Thus, a format 220 may have a back and front page printed on seven-point paper, with a wheel 220 that appears to be 21-point paper, even though the wheel 220 was printed on the same seven-point paper as the substrate 226.

In the embodiment illustrated in FIG. 5A, once format 220 has been prepared, wheel 222 rotates easily around axle 224. Because there is only a very small space between wheel 220 and axle 224, about the width of the knife edge of rotary cutter 342, wheel 220 rotates quite smoothly about the axle formed by axle 226, rather than the haphazard rotation of the wheels of the prior art. Additionally, the application of varnish to what became wheel 220 allows wheel 220 to slide easily within substrate 226.

In the embodiment illustrated in FIG. 5B, wheel 222, as well as axle 224, is glued to substrate 226. Please note that axle 224, however, is securely glued, by wet glue covering the entire area of axle 224, while wheel 222 is attached to substrate 226 only at areas 506, 508. Since wheel 222 was coated with varnish, as described above, however, the bonds between the wet glue and the varnish-coated surface of wheel 222 are easily broken. Thus, when a user attempts to turn wheel 222, by applying pressure at portion 230, there will be initial resistance that is easily overcome, after which wheel 220 will rotate freely about the axle formed by axle 226, with the advantages over the prior art as described above.

In any of the embodiments described herein, the various ribbons can be created in a variety of ways. In the preferred embodiment, a single web is printed on a single web press and is slit into a plurality of ribbons that are processed as described herein. In another embodiment, at least two separate ribbons are printed separately on a single web press and processed as described herein. In yet another embodiment, two ribbons are created on two separate web presses and combined in a single finishing operation as described herein. Other combinations of web presses and webs and ribbons are possible.

Figure 6:
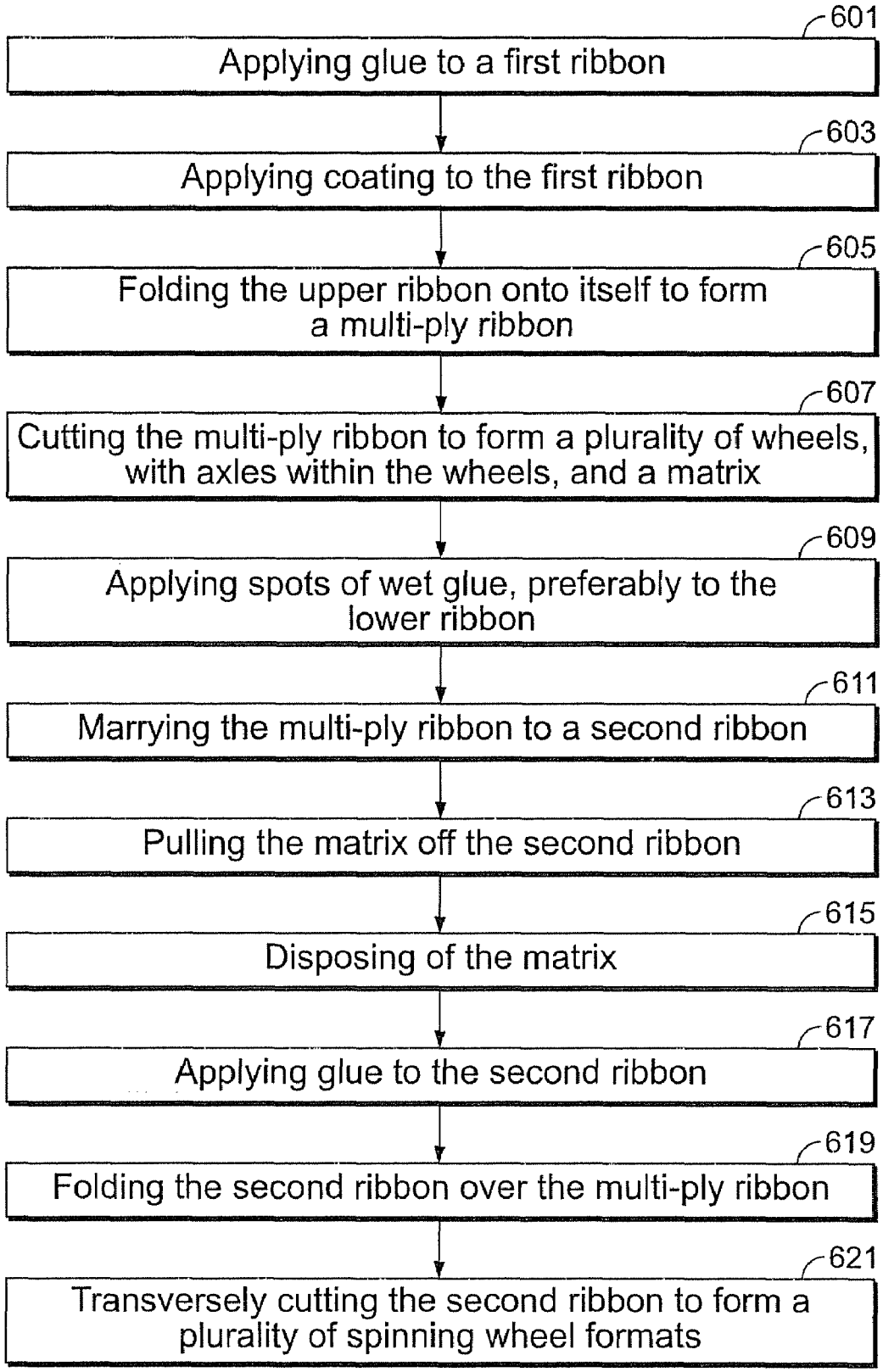
FIG. 6 is a block diagram of one embodiment of the method of the invention.

The method of the preferred embodiment of the present invention, in which a single ribbon is glued and folded to create a multi-ply ribbon, is diagramed in FIG. 6 and consists of the following steps, which are preferably (but not necessarily) performed in this order:

1. Applying glue to a first ribbon 601;
2. Applying coating to the first ribbon 603;
3. Folding (and thereby gluing) the upper ribbon onto itself to form a multi-ply ribbon 605;
4. Cutting the multi-ply ribbon to form a plurality of wheels, with axles within the wheels, and a matrix 607;
5. Applying spots of wet glue, preferably to the lower ribbon 609;
6. Marrying the multi-ply ribbon to a second ribbon 611;
7. Pulling the matrix off the second ribbon 613;
8. Disposing of the matrix 615;
9. Applying glue to the second ribbon 617;
10. Folding the second ribbon over the multi-ply ribbon 619;
11. Transversely cutting the second ribbon to form a plurality of spinning wheel formats 621.

Please note that these steps may be performed in different order without departing from the present invention. By way of examples and not by want of limitation, coating step 603 can be omitted or can be performed at various points in the process, either on the web before the ribbons are created or on the upper ribbon, the lower ribbon, or the multi-ply ribbon, and, if kiss cutting is used in place of die cutting, cutting step 609 can be performed after marrying step 613. Additionally, this method may include an additional step of cutting the second ribbon from the multi-ply ribbon, to create either a single-ply second ribbon or a second ribbon having multiple plies.

Figure 7:
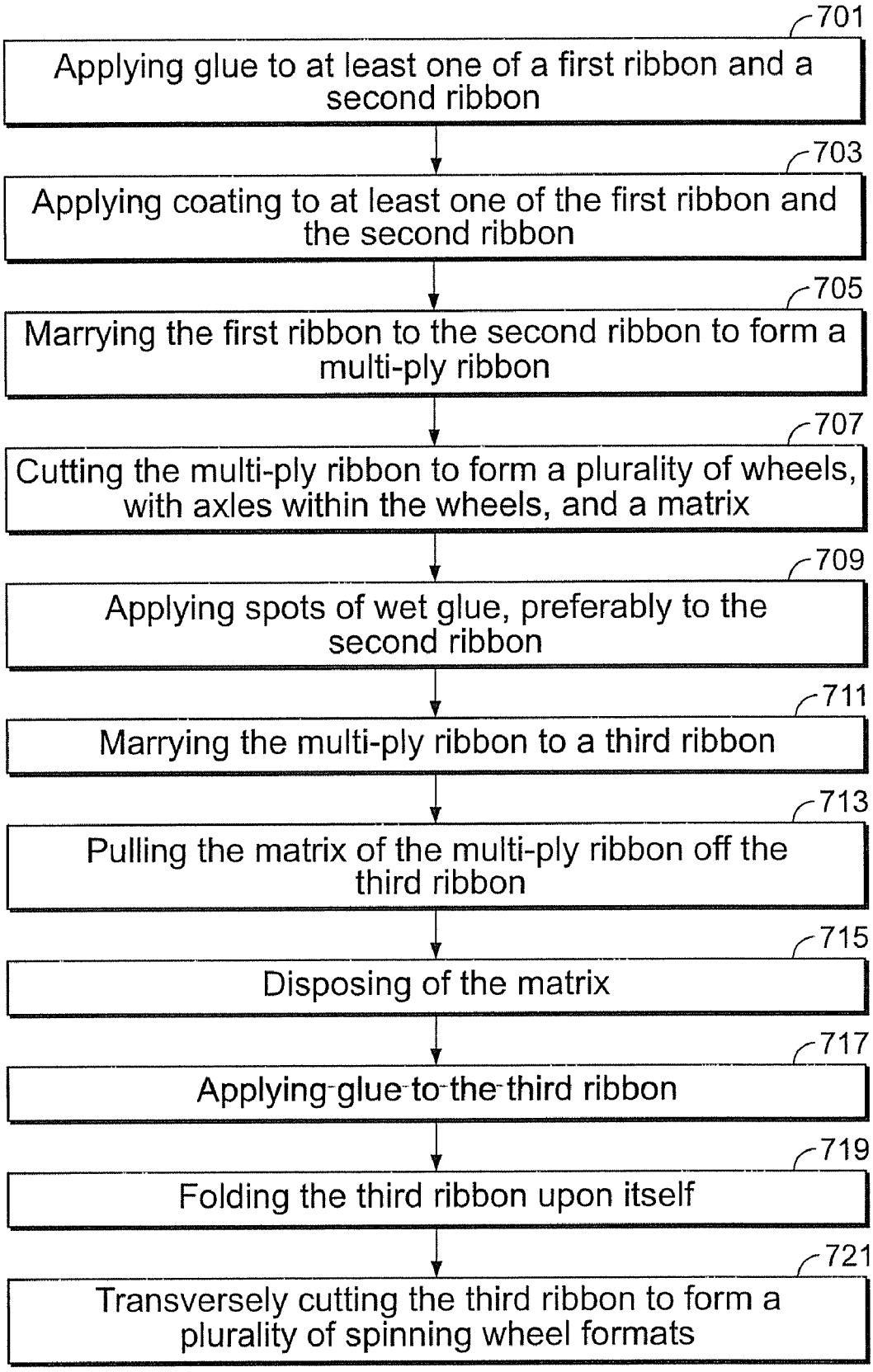
FIG. 7 is a block diagram of another embodiment of the method of the invention.

The method of the embodiment of the present invention, in which two ribbons are glued and married to create a multi-ply ribbon, is diagramed in FIG. 7 and consists of the following steps, which are preferably (but not necessarily) performed in this order:

1. Applying glue to at least one of a first ribbon and a second ribbon 701;
2. Applying coating to at least one of the first ribbon and the second ribbon 703;
3. Marrying the first ribbon to the second ribbon to form a multi-ply ribbon 705;
4. Cutting the multi-ply ribbon to form a plurality of wheels, with axles within the wheels, and a matrix 707;
5. Applying spots of wet glue, preferably to the second ribbon 709;
6. Marrying the multi-ply ribbon to a third ribbon 711;
7. Pulling the matrix of the multi-ply ribbon off the third ribbon 713;
8. Disposing of the matrix 715;
9. Applying glue to the third ribbon 717;
10. Folding the third ribbon upon itself 719;
11. Transversely cutting the third ribbon to form a plurality of spinning wheel formats 721.

Please note that these steps may be performed in different order without departing from the present invention. By way of examples and not by want of limitation, coating step 703 can be omitted or can be performed at various points in the process on either the first ribbon, the second ribbon, or the multi-ply ribbon, and, if kiss cutting is used in place of die cutting, cutting step 707 can be performed after marrying step 711.

Figure 8:
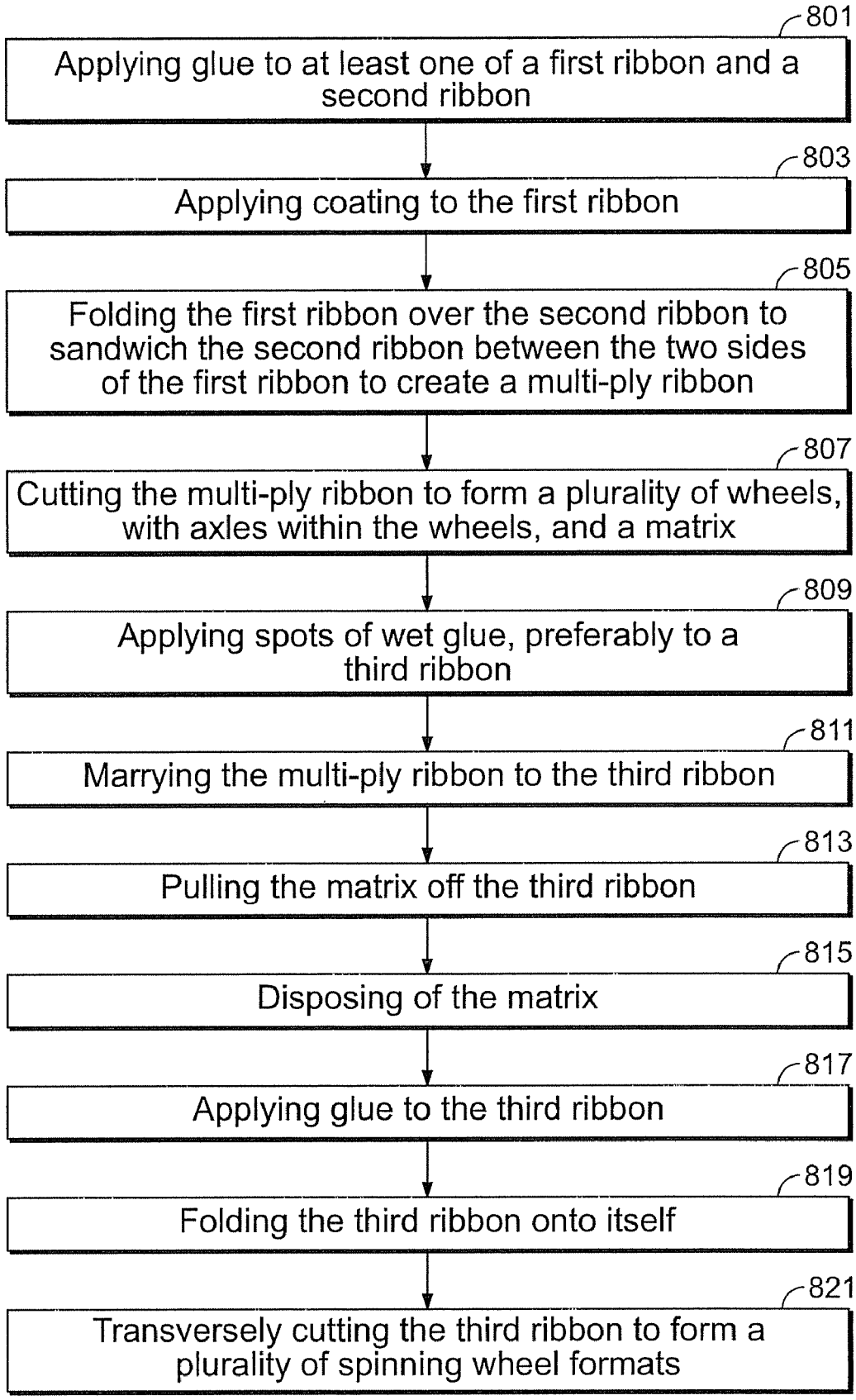
FIG. 8 is a block diagram of another embodiment of the method of the invention.

The method of the embodiment of the present invention in which a ribbon is folded inside another ribbon to create a multi-ply ribbon is diagramed in FIG. 8 and consists of the following steps, which are preferably (but not necessarily) performed in this order:

1. Applying glue to at least one of a first ribbon and a second ribbon 801;
2. Applying coating to the first ribbon 803;
3. Folding the first ribbon over the second ribbon to sandwich the second ribbon between the two sides of the first ribbon to create a multi-ply ribbon 805;
4. Cutting the multi-ply ribbon to form a plurality of wheels, with axles within the wheels, and a matrix 807;
5. Applying spots of wet glue, preferably to a third ribbon 809;
6. Marrying the multi-ply ribbon to the third ribbon 811;
7. Pulling the matrix off the third ribbon 813;
8. Disposing of the matrix 815;
9. Applying glue to the third ribbon 817;
10. Folding the third ribbon onto itself 819;
11. Transversely cutting the third ribbon to form a plurality of spinning wheel formats 821.

Please note that these steps may be performed in different order without departing from the present invention. By way of examples and not by want of limitation, coating step 803 can be omitted or can be performed at various points in the process on either the first ribbon, the third ribbon, or the multi-ply ribbon, and, if kiss cutting is used in place of die cutting, cutting step 807 can be performed after marrying step 811.

Additionally, the spinning wheel format, after it is manufactured, can be married to a mass distributable packet. Moreover, the step of printing personalized information on the web, on either of the ribbons, or the packets, may be inserted at various points of the process.

Moreover, the step of kiss cutting the multi-ply ribbon after it and the lower ribbon have been married can be made regardless of whether the two ribbons were created from one web on one web press, two webs on one web press, or two webs on two web presses. Additionally, the step of kiss cutting the multi-ply ribbon after the upper ribbon has been married to the lower ribbon can be made regardless of whether the multi-ply ribbon was made by folding a ribbon upon itself, by gluing together two or more separate ribbons, or by a combination of folding one ribbon and gluing one or more ribbons.

Moreover, under any of the embodiments of the present invention, the steps of forming a multi-ply ribbon can be deleted and the wheel can be die cut or kiss cut out of a single-ply ribbon or web. Also, the step of forming a multi-ply ribbon can be performed before slitting a web into separate ribbons or before slitting a ribbon into separate ribbons. In the preferred embodiment, the spinning wheel format has a multi-ply wheel and a single-ply substrate, but the invention can also be used to create a spinning wheel format with a multi-ply substrate.

Additionally, a step of printing personalized information on any of a web, one of the ribbons, or the spinning wheel formats themselves, packets, may be inserted at various points of the process. Moreover, the spinning wheel format, after it is manufactured, can be married to a mass distributable packet.

While preferred embodiments of the present invention are shown and described, it is envisioned that those skilled in the art may devise various modifications of the present invention.

The invention claimed is:

1. A method of making spinning wheel formats in a continuous, single-path finishing system, comprising:

permanently adhering a first ribbon to a second ribbon to form a multi-ply ribbon;

cutting Mid multi-ply ribbon to form a plurality of multi-ply wheels and a plurality of multi-ply axles within mid wheels;

marrying said multi-ply ribbon to a third ribbon;

folding said third ribbon to enclose said multi-ply ribbon within said folded third ribbon; and transversely cutting said third ribbon into a plurality of spinning wheel formats.

2. The method of claim 1, further comprising applying a coating to at least one of said first ribbon, said second ribbon, said third ribbon, and said multi-ply ribbon.

3. The method of claim 1, further comprising printing personalized information on at least one of mid first ribbon, said second ribbon, said third ribbon, said multi-ply ribbon, and said spinning wheel formats.

4. The method of claim 1, wherein said cutting said multi-ply ribbon step comprises die cutting said cutting said multi-ply ribbon to create an outside portion.

5. The method of claim 4, further comprising removing said outside portion.

6. The method of claim 5, wherein said removing step comprises pulling said outside portion with a pulling miler.

7. The method of claim 1, wherein said cutting Mid multi-ply ribbon step comprises kiss-cutting said mold-ply ribbon to create an outside portion.

8. The method of claim 7, further comprising removing said outside portion.

9. The method of claim 8, wherein said removing step comprises pulling said outside portion with a pulling roller.

10. The method of claim 1, further comprising finishing at least one of said first ribbon, said second ribbon, said third ribbon, and said multi-ply ribbon, before mid marrying step.

11. The method of claim 1 further comprising finishing said first ribbon, said second ribbon, said third ribbon, said multi-ply ribbon, and said spinning wheel formats after said marrying step.

12. The method of claim 1, wherein said cutting step creates die cuts with tabs.

13. A method of manufacturing mass distributable packets, comprising the method of claim 1 and further comprising the steps of:

marrying said plurality of spinning wheel formats to a fourth ribbon, and manufacturing a plurality of mass distributable packets from said fourth ribbon.

* * * * *

UNITED STATES PATENT AND TRADEMARK OFFICE

CERTIFICATE OF CORRECTION

PATENT NO. : 7,618,032 B2
APPLICATION NO. : 11/279024
DATED : November 17, 2009
INVENTOR(S) : David Deschryver It is certified that error appears in the above-identified patent and that said Letters Patent is hereby corrected as shown below:

Column 12, Line 14 "pulling miler." should read -- pulling roller. --

Column 12, Line 15 "Mid multi-" should read -- said multi- --

Signed and Sealed this

Eighth Day of June, 2010

David J. Kappos

David J. Kappos
*Director of the United States Patent and Trademark Office*